US011806779B2

(12) United States Patent
Felberbaum et al.

(10) Patent No.: US 11,806,779 B2
(45) Date of Patent: Nov. 7, 2023

(54) SYSTEMS AND METHODS FOR MAKING THICK GAUGE ALUMINUM ALLOY ARTICLES

(71) Applicant: Novelis Inc., Atlanta, GA (US)

(72) Inventors: Milan Felberbaum, Woodstock, GA (US); Corrado Bassi, Salgesch (CH); Sazol Kumar Das, Acworth, GA (US); Simon Barker, Woodstock, GA (US); Tudor Piroteala, Acworth, GA (US); Rajasekhar Talla, Woodstock, GA (US)

(73) Assignee: Novelis Inc., Atlanta, GA (US)

( * ) Notice: Subject to any disclaimer, the term of this patent is extended or adjusted under 35 U.S.C. 154(b) by 596 days.

(21) Appl. No.: 15/716,581

(22) Filed: Sep. 27, 2017

(65) Prior Publication Data

US 2018/0117669 A1 May 3, 2018

Related U.S. Application Data

(60) Provisional application No. 62/529,028, filed on Jul. 6, 2017, provisional application No. 62/505,944, filed
(Continued)

(51) Int. Cl.
*B22D 11/00* (2006.01)
*C22F 1/04* (2006.01)
(Continued)

(52) U.S. Cl.
CPC ..... *B22D 11/003* (2013.01); *B21B 1/26* (2013.01); *B21B 1/463* (2013.01); *B21B 13/22* (2013.01);
(Continued)

(58) Field of Classification Search
CPC ..... B22D 11/003; B21B 1/26; C22F 1/002; C22F 1/04
See application file for complete search history.

(56) References Cited

U.S. PATENT DOCUMENTS 4,174,232 A 11/1979 Lenz et al.
4,194,553 A 3/1980 Kimura et al.
(Continued)

FOREIGN PATENT DOCUMENTS

CA 2900625 A1 8/2014
CN 1207965 A 2/1999
(Continued)

OTHER PUBLICATIONS

Davis, J.R. "Aluminum and Aluminum Alloys", ASM International, p. 300-303. (Year: 1993).*
(Continued)

*Primary Examiner* — George Wyszomierski
*Assistant Examiner* — Janell C Morillo
(74) *Attorney, Agent, or Firm* — Kilpatrick Townsend & Stockton LLP

(57) ABSTRACT

Provided herein are systems and methods for producing thick gauge aluminum alloy articles such as plates, shates, slabs, sheet plates or the like. A method for producing thick gauge aluminum alloy articles can include continuously casting an aluminum alloy article and hot or warm rolling the aluminum alloy article. Also provided herein is a continuous casting system for producing thick gauge aluminum alloy articles. The disclosed thick gauge aluminum alloy articles can be provided in any suitable temper.

12 Claims, 3 Drawing Sheets

Related U.S. Application Data on May 14, 2017, provisional application No. 62/413,591, filed on Oct. 27, 2016, provisional application No. 62/413,740, filed on Oct. 27, 2016, provisional application No. 62/413,764, filed on Oct. 27, 2016.

(51) Int. Cl.

| | |
|---|---|
| ***B21B 1/26*** | (2006.01) |
| ***B22D 11/06*** | (2006.01) |
| ***B22D 11/12*** | (2006.01) |
| ***B22D 11/126*** | (2006.01) |
| ***B21B 1/46*** | (2006.01) |
| ***B21B 13/22*** | (2006.01) |
| ***B21B 15/00*** | (2006.01) |
| ***C22F 1/00*** | (2006.01) |
| ***C22F 1/047*** | (2006.01) |
| *B21B 1/22* | (2006.01) |
| *B21B 3/00* | (2006.01) |

(52) U.S. Cl.

CPC ..... *B21B 15/00* (2013.01); *B22D 11/0605* (2013.01); *B22D 11/0631* (2013.01); *B22D 11/126* (2013.01); *B22D 11/1206* (2013.01); *C22F 1/002* (2013.01); *C22F 1/04* (2013.01); *C22F 1/047* (2013.01); *B21B 2001/225* (2013.01); *B21B 2003/001* (2013.01); *B21B 2015/0057* (2013.01)

(56) References Cited

U.S. PATENT DOCUMENTS

| | | | | |
|---|---|---|---|---|
| 4,238,248 | A | 12/1980 | Gyongyos et al. | |
| 4,698,897 | A | 10/1987 | Frommann et al. | |
| 4,808,247 | A | 2/1989 | Komatsubara et al. | |
| 4,823,860 | A | 4/1989 | Lauener | |
| 4,869,310 | A | 9/1989 | Yanagi et al. | |
| 4,976,024 | A | 12/1990 | Kimura | |
| 5,046,347 | A | 9/1991 | Crosato et al. | |
| 5,461,770 | A | 10/1995 | Kimura et al. | |
| 5,548,882 | A | 8/1996 | Windhaus et al. | |
| 5,560,789 | A | 10/1996 | Sainfort et al. | |
| 5,720,335 | A | 2/1998 | Osada et al. | |
| 5,779,824 | A | 7/1998 | Sawada et al. | |
| 6,289,972 | B1 | 9/2001 | Benedetti | |
| 6,471,796 | B1 | 10/2002 | Kagohara et al. | |
| 6,755,236 | B1 | 6/2004 | Sivilotti et al. | |
| 7,380,583 | B2 | 6/2008 | Gallerneault et al. | |
| 7,448,432 | B2 | 11/2008 | Barker et al. | |
| 10,493,508 | B2 | 12/2019 | Bassi et al. | |
| 10,533,243 | B2 | 1/2020 | Newman et al. | |
| 2003/0150587 | A1* | 8/2003 | Li | C22F 1/04 164/452 |
| 2003/0173003 | A1 | 9/2003 | Selepack et al. | |
| 2004/0011438 | A1 | 1/2004 | Lorentzen et al. | |
| 2004/0089382 | A1 | 5/2004 | Senkov et al. | |
| 2005/0028894 | A1 | 2/2005 | Hoffmann et al. | |
| 2005/0211350 | A1 | 9/2005 | Unal et al. | |
| 2007/0209739 | A1 | 9/2007 | Zhao | |
| 2008/0035301 | A1 | 2/2008 | Arvedi | |
| 2009/0178778 | A1 | 7/2009 | Seidel et al. | |
| 2010/0212856 | A1 | 8/2010 | Rosenthal et al. | |
| 2011/0111081 | A1* | 5/2011 | Chen | C22C 21/10 425/542 |
| 2012/0024434 | A1 | 2/2012 | Franz et al. | |
| 2013/0334091 | A1 | 12/2013 | Sawtell et al. | |
| 2014/0000768 | A1* | 1/2014 | Sawtell | C22C 21/08 148/551 |
| 2014/0250963 | A1 | 9/2014 | Nelson et al. | |
| 2015/0218679 | A1 | 8/2015 | Aruga et al. | |
| 2015/0252461 | A1 | 9/2015 | Kokubo et al. | |
| 2015/0328670 | A1 | 11/2015 | Alken et al. | |
| 2017/0175240 | A1 | 6/2017 | Wen et al. | |
| 2017/0198376 | A1 | 7/2017 | Newman et al. | |
| 2018/0087138 | A1 | 3/2018 | Gaensbauer et al. | |
| 2018/0112296 | A1 | 4/2018 | Bryant et al. | |
| 2018/0112298 | A1* | 4/2018 | Weykamp | C22F 1/053 |
| 2018/0117650 | A1 | 5/2018 | Felberbaum et al. | |
| 2018/0119261 | A1 | 5/2018 | Das et al. | |
| 2018/0119262 | A1 | 5/2018 | Felberbaum et al. | |
| 2018/0297092 | A1 | 10/2018 | Chung et al. | |
| 2019/0022720 | A1 | 1/2019 | Shafiei et al. | |
| 2019/0022721 | A1 | 1/2019 | Shafiei et al. | |
| 2019/0022724 | A1 | 1/2019 | Shafiei et al. | |
| 2019/0054519 | A1 | 2/2019 | Barker | |

FOREIGN PATENT DOCUMENTS

| | | | | | |
|---|---|---|---|---|---|
| CN | 1505692 | A | | 6/2004 | |
| CN | 1662670 | A | | 8/2005 | |
| CN | 1942595 | | | 4/2007 | |
| CN | 101896631 | A | | 11/2010 | |
| CN | 102066596 | A | | 5/2011 | |
| CN | 102413955 | A | | 4/2012 | |
| CN | 103119185 | | | 5/2013 | |
| CN | 103131904 | A | | 6/2013 | |
| CN | 103510029 | A | | 1/2014 | |
| CN | 103764305 | A | | 4/2014 | |
| CN | 104109784 | A | | 10/2014 | |
| CN | 104284745 | A | | 1/2015 | |
| CN | 104411846 | A | | 3/2015 | |
| CN | 104583433 | A | | 4/2015 | |
| CN | 104762575 | A | | 7/2015 | |
| CN | 105397045 | A | * | 3/2016 | B22D 11/003 |
| CN | 105734369 | A | | 7/2016 | |
| CN | 105814222 | A | | 7/2016 | |
| EP | 2813592 | | | 12/2014 | |
| GB | 2027743 | | | 2/1980 | |
| JP | 60152348 | | | 8/1985 | |
| JP | S621839 | A | | 1/1987 | |
| JP | 6289502 | A | | 4/1987 | |
| JP | S6283453 | A | | 4/1987 | |
| JP | 63252604 | A | | 10/1988 | |
| JP | H06322493 | A | | 11/1994 | |
| JP | H0790459 | A | | 4/1995 | |
| JP | 07252573 | | | 10/1995 | |
| JP | 09327706 | A | | 12/1997 | |
| JP | 10502973 | A | | 3/1998 | |
| JP | 10130768 | A | | 5/1998 | |
| JP | 2000017412 | | | 1/2000 | |
| JP | 2000210760 | A | | 8/2000 | |
| JP | 2000212673 | | | 8/2000 | |
| JP | 2001518140 | A | | 10/2001 | |
| JP | 2006299420 | A | | 11/2006 | |
| JP | 2007031819 | | | 2/2007 | |
| JP | 2007262484 | A | * | 10/2007 | |
| JP | 2007262484 | A | | 10/2007 | |
| JP | 2008076297 | A | | 4/2008 | |
| JP | 2008190022 | A | | 8/2008 | |
| JP | 2014047384 | A | | 3/2014 | |
| JP | 2014219222 | A | | 11/2014 | |
| JP | 2016160515 | A | | 9/2016 | |
| JP | 2016160516 | A | | 9/2016 | |
| KR | 940010443 | | | 5/1994 | |
| KR | 940010443 | B1 | | 10/1994 | |
| KR | 20080014744 | A | | 2/2008 | |
| RU | 99126709 | A | | 10/2001 | |
| RU | 2292967 | | | 2/2007 | |
| RU | 2299256 | | | 5/2007 | |
| RU | 2305022 | | | 8/2007 | |
| RU | 2313594 | | | 12/2007 | |
| RU | 2008139893 | | | 4/2010 | |
| RU | 2397842 | | | 8/2010 | |
| RU | 102550 | | | 3/2011 | |
| RU | 2415193 | | | 3/2011 | |
| SU | 1306484 | | | 4/1987 | |
| WO | 9711205 | | | 3/1997 | |
| WO | 9811205 | | | 3/1998 | |
| WO | 0037190 | A1 | | 6/2000 | |
| WO | 0144532 | | | 6/2001 | |
| WO | 2008003504 | A2 | | 1/2008 | |
| WO | 2008016169 | | | 2/2008 | |

(56) References Cited

FOREIGN PATENT DOCUMENTS

| | | |
|---|---|---|
| WO | 2009130175 A1 | 10/2009 |
| WO | 2013133960 | 9/2013 |
| WO | 2016090026 | 6/2016 |

OTHER PUBLICATIONS

Australian Application No. 2017350368 , "First Examination Report", dated Nov. 19, 2019, 3 pages.
Chinese Application No. 201780066612.2 , "Office Action", dated Jan. 3, 2020, 22 pages.
Russian Application No. 2019112660 , "Office Action", dated Jan. 22, 2020, 15 pages.
PCT/US2017/053720, International Search Report and Written Opinion, dated Nov. 30, 2017, 16 pages.
Lohne et al., "Quench sensitivity in AlMgSi alloys containing manganese or chromium", Scandinavian J of Met 12 (1983) 34-36.
Prince, "The effects of dispersoids upon the micromechanisms of crack propagation in Al Mg Si alloys", Acta Mett. (1979) vol. 27, 1401-08.
Zhao et al., "Effect of Mn contents on the bake hardenability and bendability of Al-0.6mass%Mg-0.8mass%Si alloy sheets", J. Jpn. Inst. Light Metal. 55( 5) 2005 227-232.
Canadian Patent Application No. 3,041,474 , Office Action, dated Jul. 20, 2020, 7 pages.
Chinese Patent Application No. 201780066612.2 , Office Action, dated Aug. 24, 2020, 17 pages.
Korean Patent Application No. 10-2019-7014694 , Office Action, dated Aug. 12, 2020, 15 pages.
Song et al., "The Role of Tin in the Hot-Ductility Deterioration of a Low-Carbon Steel", Metallurgical and Materials Transactions A, vol. 34, No. 8, Aug. 2003, pp. 1611-1616.
European Patent Application No. 17791201.1 , Office Action dated May 15, 2020, 5 pages.
Japanese Patent Application No. 2019-542346 , Office Action dated May 26, 2020, 6 pages.
European Patent Application No. 17791201.1, Office Action dated Oct. 19, 2020, 6 pages.
Japanese Patent Application No. 2019-542346, Office Action dated Nov. 4, 2020, 6 pages.
Korean Patent Application No. 10-2019-7014694, Office Action dated Jan. 11, 2021, 15 pages.
Indian Patent Application No. 201917015855, First Examination Report dated Feb. 1, 2021, 6 pages.
Canadian Patent Application No. 3,041,474 , Office Action dated Jun. 2, 2021, 9 pages.
Chinese Patent Application No. 201780066612.2 , Office Action dated Mar. 19, 2021, 17 pages.
European Application No. 17791201.1, Notice of Decision to Grant, dated Aug. 5, 2021, 3 pages.
Korean Application No. 10-2019-7014694 , Office Action, dated Jul. 27, 2021, 13 pages.
Tong et al., "5000 Questions On New Technology Of Energy Saving And Emission Reduction In Steel Works", China Science And Technology Press, Jul. 31, 2009, pp. 1-4.
U.S. Appl. No. 17/085,466 , "Notice of Allowance", dated Nov. 10, 2022, 8 pages.
EP17781312.8 , "Intention to Grant", dated Dec. 23, 2020, 79 pages.
EP17790884.5 , "Intention to Grant", dated Oct. 1, 2021, 39 pages.
EP17791201.1 , "Intention to Grant", dated Apr. 15, 2021, 36 pages.
JP2020-136203 , "Office Action", dated Oct. 25, 2022, 23 pages.
JP2021-134099, "Office Action", dated Nov. 15, 2022, 3 pages.
KR10-2022-7013242 , "Notice of Decision to Grant", dated Nov. 4, 2022, 6 pages.
U.S. Appl. No. 15/716,654 , "Non-Final Office Action", dated Dec. 8, 2022, 8 pages.
U.S. Appl. No. 15/716,657 , "Non-Final Office Action", dated Dec. 21, 2022, 9 pages.
EP17790885.2 , "Intention to Grant", dated Jan. 9, 2023, 5 pages.
KR1020217023150 , "Office Action", dated Dec. 7, 2022, 5 pages.
U.S. Appl. No. 15/716,654 , "Final Office Action", dated Aug. 17, 2022, 9 pages.
U.S. Appl. No. 15/716,657 , "Final Office Action", dated Aug. 18, 2022, 9 pages.
U.S. Appl. No. 17/085,466 , "Non-Final Office Action", dated Jul. 27, 2022, 12 pages.
BR112019007379-5 , "Notice of Allowance", dated Sep. 6, 2022.
BR112019008427-4 , "Notice of Allowance", dated Oct. 4, 2022.
CA3,041,474 , "Notice of Allowance", dated Sep. 28, 2022, 1 page.
CA3,041,580 , "Office Action", dated Oct. 21, 2022, 4 pages.
CN201780066634.9 , "Notice of Decision to Grant", dated Aug. 24, 2022, 5 pages.
EP17790885.2 , "Office Action", dated Jun. 15, 2022, 5 pages.
EP21170636.1 , "Office Action", dated Jul. 18, 2022, 5 pages.
KR10-2021-7023150 , "Office Action", dated Aug. 30, 2022, 8 pages.
MX/A/2019/004835 , "Notice of Allowance", dated Sep. 2, 2022, 2 pages.
Brazilian Application No. 112019007596-8 , Office Action, dated Jan. 25, 2022, 5 pages.
Canadian Application No. 3,041,474 , Office Action, dated Jan. 17, 2022, 4 pages.
Chinese Application No. 201780066612.2 , Notice of Decision to Grant, dated May 6, 2022, 6 pages.

* cited by examiner

SYSTEMS AND METHODS FOR MAKING THICK GAUGE ALUMINUM ALLOY ARTICLES

CROSS-REFERENCE TO RELATED APPLICATIONS

This application claims the benefit of U.S. Provisional Application No. 62/529,028, filed Jul. 6, 2017 and titled "SYSTEMS AND METHODS FOR MAKING ALUMINUM ALLOY PLATES"; 62/413,740, filed Oct. 27, 2016 and titled "HIGH STRENGTH 6XXX SERIES ALUMINUM ALLOY AND METHODS OF MAKING THE SAME"; 62/413,764, filed Oct. 27, 2016 and titled "HIGH STRENGTH 7XXX SERIES ALUMINUM ALLOY AND METHODS OF MAKING THE SAME"; 62/413,591, filed Oct. 27, 2016 and titled "DECOUPLED CONTINUOUS CASTING AND ROLLING LINE"; and 62/505,944, filed May 14, 2017 and titled "DECOUPLED CONTINUOUS CASTING AND ROLLING LINE," the contents of all of which are incorporated herein by reference in their entireties.

Additionally, the present application is related to U.S. Non-Provisional patent application Ser. No. 15/717,361 to Milan Felberbaum et al., entitled "METAL CASTING AND ROLLING LINE" filed Sep. 27, 2017, the disclosure of which is hereby incorporated by reference in its entirety.

TECHNICAL FIELD

The present disclosure relates to metallurgy generally and more specifically to metal plate manufacturing.

BACKGROUND

Current methods of producing thick gauge (e.g., greater than 4 millimeters (mm) in thickness) aluminum alloy articles require numerous processing steps including subjecting a nascent aluminum alloy body to thermal treatment processes for long durations. It can be desirable to reduce the number of steps and overall time required to produce aluminum alloy articles with desirable thermal treatment.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Examples of the present disclosure include a method for producing rolled aluminum alloy articles comprising providing a molten aluminum alloy, continuously casting an aluminum alloy article from the molten aluminum alloy, and hot or warm rolling the aluminum alloy article at a rolling temperature of at least about 400° C. to a gauge of about 4 millimeters (mm) or greater to produce a thick gauge aluminum alloy article.

Examples of the present disclosure also include a continuous casting system comprising a pair of moving opposed casting surfaces, a casting cavity between the pair of moving opposed casting surfaces, a molten metal injector positioned adjacent to the pair of moving opposed casting surfaces, wherein molten metal can be injected into the casting cavity between the pair of moving opposed casting surfaces, a furnace (e.g., a solutionizing furnace) positioned downstream of the pair of moving opposed casting surfaces, a rolling mill (e.g., a hot rolling mill or a warm rolling mill) positioned downstream of the furnace, a quenching device positioned downstream of the rolling mill, a cutting device (e.g., a shearing device) positioned downstream of the quenching device, and a stacking device positioned downstream of the cutting device.

Examples of the present disclosure further include a rolled aluminum alloy article, which is formed by the methods and systems described herein, wherein the rolled aluminum alloy article is provided in a controlled temper. In some cases, the rolled aluminum alloy article is a thick gauge aluminum alloy article, such as, but not limited to, plates, shates, slabs, sheet plates and the like.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
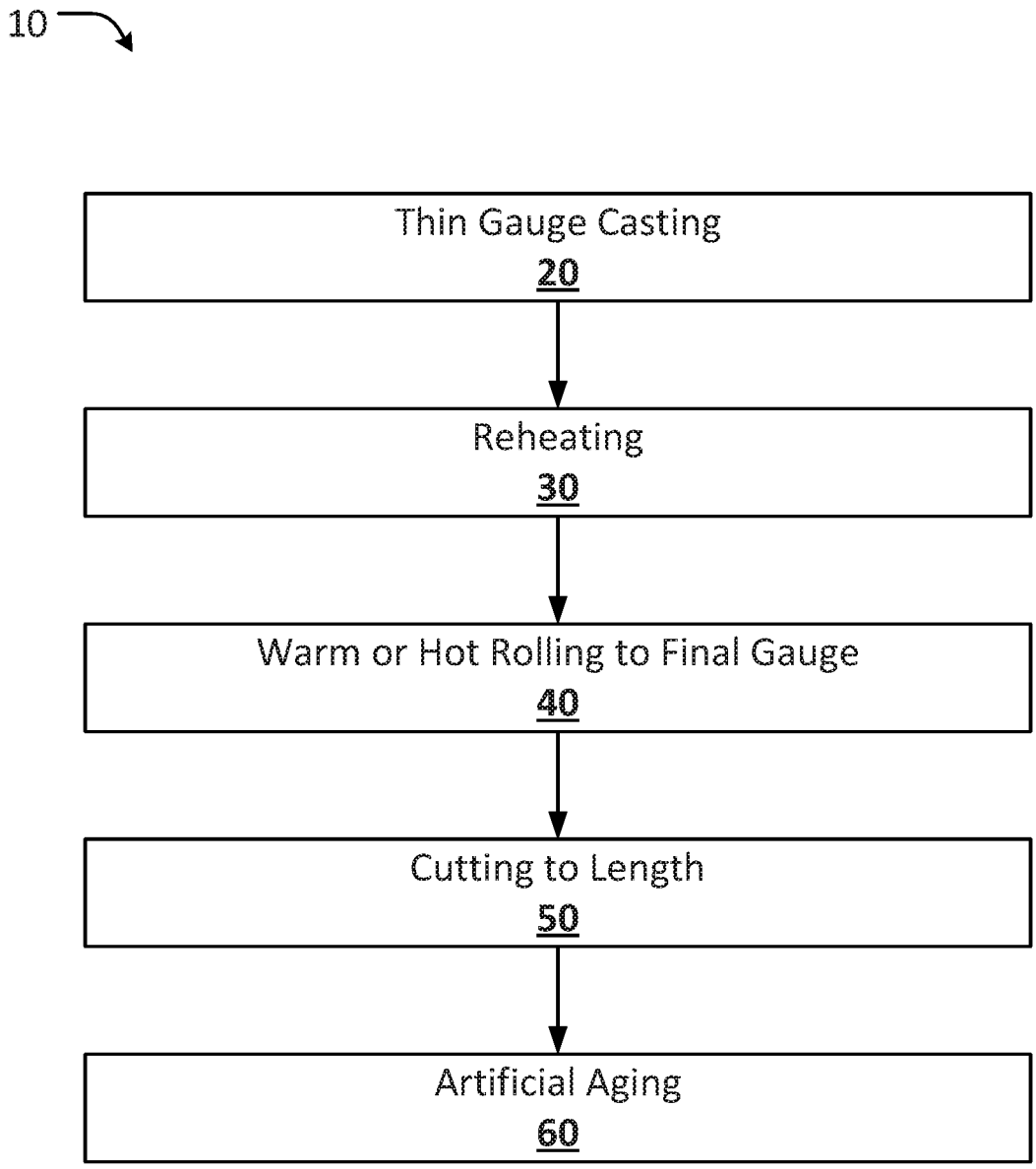
FIG. 1 is a flowchart depicting a process for producing an aluminum alloy article according to certain aspects of the present disclosure.

Certain aspects and features of the present disclosure relate to techniques for producing thick gauge aluminum alloy articles, such as, but not limited to, plates, shates, slabs, sheet plates and the like. The disclosed techniques include providing a molten aluminum alloy, continuously casting an aluminum alloy article from the molten aluminum alloy, optionally reheating (e.g., solutionizing) the cast aluminum alloy article, and hot or warm rolling the aluminum alloy article at a rolling temperature of at least about 400° C. to a gauge of about 4 mm or greater to produce a thick gauge aluminum alloy article.

In some cases, the optional reheating can include heating the cast aluminum alloy article to a solutionizing temperature at or above the solvus temperature for the cast aluminum alloy article, although lower reheating temperatures may be used. In some cases, the optional reheating can include reheating the cast aluminum alloy article to a temperature at or above a minimum peak metal temperature of at or approximately 405° C., 410° C., 415° C., 420° C., 425° C., 430° C., 435° C., 440° C., 445° C., 450° C., 455° C., 460° C., 465° C., 470° C., 475° C., 480° C., 485° C., 490° C., 495° C., 500° C., 505° C., 510° C., 515° C., 520° C., 525° C., 530° C., 535° C., 540° C., 545° C., 550° C., 555° C., 560° C., 565° C., 570° C., 575° C., 580° C., 585°

C., or 590° C. In some cases, the optional reheating can include reheating an AA6xxx series cast aluminum alloy article to a peak metal temperature between 550° C.-570° C. or 555° C.-565° C., or at or approximately 560° C. In some cases, the optional reheating can include reheating an AA7xxx series cast aluminum alloy article to a peak metal temperature between 470° C.-490° C. or 475° C.-485° C., or at or approximately 480° C.

Certain aspects and features of the present disclosure further relate to a continuous casting system. The continuous casting system includes a pair of moving opposed casting surfaces and a casting cavity between the pair of moving opposed casting surfaces. The continuous casting system can also include a furnace (e.g. solutionizing furnace) positioned downstream of the pair of moving opposed casting surfaces and a rolling mill positioned downstream of the furnace. The system further includes a quenching device positioned downstream of the rolling mill. In some cases, the system further has a shearing device positioned downstream of the quenching device and a stacking device positioned downstream of the shearing device.

Certain aspects and features of the present disclosure also relate to an aluminum alloy article, which is formed by the methods and systems described herein and is provided in a controlled temper. In some cases, the aluminum alloy article produced according to certain aspects and features of the present disclosure is able to be produced more efficiently and with less cost, waste, and/or energy usage per kilogram of produced aluminum alloy article than conventional techniques.

The terms "invention," "the invention," "this invention" and "the present invention" used herein are intended to refer broadly to all of the subject matter of this patent application and the claims below. Statements containing these terms should be understood not to limit the subject matter described herein or to limit the meaning or scope of the patent claims below.

As used herein, the meaning of "a," "an," or "the" includes singular and plural references unless the context clearly dictates otherwise.

In this description, reference is made to alloys identified by aluminum industry designations, such as "series" or "AA6xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, thick gauge articles have a thickness of about 4 mm or greater, and can include, but are not limited to, plates, shates, slabs, sheet plates and the like.

Reference is made in this application to alloy temper or condition. For an understanding of the alloy temper descriptions most commonly used, see "American National Standards (ANSI) H35 on Alloy and Temper Designation Systems." An F condition or temper refers to an aluminum alloy as fabricated. An O condition or temper refers to an aluminum alloy after annealing. A T3 condition or temper refers to an aluminum alloy after solutionizing, cold working and natural aging. A T4 condition or temper refers to an aluminum alloy after solutionizing followed by natural aging. A T6 condition or temper refers to an aluminum alloy after solutionizing followed by artificial aging. A T7 condition or temper refers to an aluminum alloy after solutionizing, quenching, and artificially overaging. A T8 condition or temper refers to an aluminum alloy after solutionizing, followed by cold working, followed by artificial aging.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

In some non-limiting examples, a method for producing thick gauge aluminum alloy articles can include providing a molten aluminum alloy, continuously casting an aluminum alloy article from the molten aluminum alloy, and warm or hot rolling the aluminum alloy article to produce, for example, a thick gauge aluminum alloy article such as an aluminum alloy plate, shate, slab, sheet plate or other article having a gauge of about 4 mm or greater.

In some cases, the molten aluminum alloy can be an AA2xxx series aluminum alloy, an AA5xxx series aluminum alloy, an AA6xxx series aluminum alloy, or an AA7xxx series aluminum alloy.

Optionally, the aluminum alloy as described herein can be an AA2xxx aluminum alloy according to one of the following aluminum alloy designations: AA2001, A2002, AA2004, AA2005, AA2006, AA2007, AA2007A, AA2007B, AA2008, AA2009, AA2010, AA2011, AA2011A, AA2111, AA2111A, AA2111B, AA2012, AA2013, AA2014, AA2014A, AA2214, AA2015, AA2016, AA2017, AA2017A, AA2117, AA2018, AA2218, AA2618, AA2618A, AA2219, AA2319, AA2419, AA2519, AA2021, AA2022, AA2023, AA2024, AA2024A, AA2124, AA2224, AA2224A, AA2324, AA2424, AA2524, AA2624, AA2724, AA2824, AA2025, AA2026, AA2027, AA2028, AA2028A, AA2028B, AA2028C, AA2029, AA2030, AA2031, AA2032, AA2034, AA2036, AA2037, AA2038, AA2039, AA2139, AA2040, AA2041, AA2044, AA2045, AA2050, AA2055, AA2056, AA2060, AA2065, AA2070, AA2076, AA2090, AA2091, AA2094, AA2095, AA2195, AA2295, AA2196, AA2296, AA2097, AA2197, AA2297, AA2397, AA2098, AA2198, AA2099, or AA2199.

Optionally, the aluminum alloy as described herein can be an AA5xxx aluminum alloy according to one of the following aluminum alloy designations: AA5005, AA5005A, AA5205, AA5305, AA5505, AA5605, AA5006, AA5106, AA5010, AA5110, AA5110A, AA5210, AA5310, AA5016, AA5017, AA5018, AA5018A, AA5019, AA5019A, AA5119, AA5119A, AA5021, AA5022, AA5023, AA5024, AA5026, AA5027, AA5028, AA5040, AA5140, AA5041, AA5042, AA5043, AA5049, AA5149, AA5249, AA5349, AA5449, AA5449A, AA5050, AA5050A, AA5050C, AA5150, AA5051, AA5051A, AA5151, AA5251, AA5251A, AA5351, AA5451, AA5052, AA5252, AA5352, AA5154, AA5154A, AA5154B, AA5154C, AA5254, AA5354, AA5454, AA5554, AA5654, AA5654A, AA5754, AA5854, AA5954, AA5056, AA5356, AA5356A, AA5456, AA5456A, AA5456B, AA5556, AA5556A, AA5556B, AA5556C, AA5257, AA5457, AA5557, AA5657, AA5058, AA5059, AA5070, AA5180, AA5180A, AA5082, AA5182, AA5083, AA5183, AA5183A, AA5283, AA5283A, AA5283B, AA5383, AA5483, AA5086, AA5186, AA5087, AA5187, or AA5088.

Optionally, the aluminum alloy as described herein can be an AA6xxx aluminum alloy according to one of the following aluminum alloy designations: AA6101, AA6101A, AA6101B, AA6201, AA6201A, AA6401, AA6501, AA6002, AA6003, AA6103, AA6005, AA6005A, AA6005B, AA6005C, AA6105, AA6205, AA6305, AA6006, AA6106, AA6206, AA6306, AA6008, AA6009, AA6010, AA6110, AA6110A, AA6011, AA6111, AA6012, AA6012A, AA6013, AA6113, AA6014, AA6015, AA6016, AA6016A, AA6116, AA6018, AA6019, AA6020, AA6021, AA6022, AA6023, AA6024, AA6025, AA6026, AA6027, AA6028, AA6031, AA6032, AA6033, AA6040, AA6041, AA6042, AA6043, AA6151, AA6351, AA6351A, AA6451, AA6951, AA6053, AA6055, AA6056, AA6156, AA6060, AA6160, AA6260, AA6360, AA6460, AA6460B, AA6560, AA6660, AA6061, AA6061A, AA6261, AA6361, AA6162, AA6262, AA6262A, AA6063, AA6063A, AA6463, AA6463A, AA6763, A6963, AA6064, AA6064A, AA6065, AA6066, AA6068, AA6069, AA6070, AA6081, AA6181, AA6181A, AA6082, AA6082A, AA6182, AA6091, or AA6092.

Optionally, the aluminum alloy as described herein can be an AA7xxx aluminum alloy according to one of the following aluminum alloy designations: AA7011, AA7019, AA7020, AA7021, AA7039, AA7072, AA7075, AA7085, AA7108, AA7108A, AA7015, AA7017, AA7018, AA7019A, AA7024, AA7025, AA7028, AA7030, AA7031, AA7033, AA7035, AA7035A, AA7046, AA7046A, AA7003, AA7004, AA7005, AA7009, AA7010, AA7011, AA7012, AA7014, AA7016, AA7116, AA7122, AA7023, AA7026, AA7029, AA7129, AA7229, AA7032, AA7033, AA7034, AA7036, AA7136, AA7037, AA7040, AA7140, AA7041, AA7049, AA7049A, AA7149, AA7249, AA7349, AA7449, AA7050, AA7050A, AA7150, AA7250, AA7055, AA7155, AA7255, AA7056, AA7060, AA7064, AA7065, AA7068, AA7168, AA7175, AA7475, AA7076, AA7178, AA7278, AA7278A, AA7081, AA7181, AA7185, AA7090, AA7093, AA7095, and AA7099.

FIG. 1 is a process flowchart 10 depicting the method for producing thick gauge aluminum alloy articles, such as plates, shates, slabs, sheet plates or other articles having a gauge of about 4 mm or greater. In box 20, thin gauge casting refers to continuously casting an aluminum alloy article. In some aspects, continuously casting an aluminum alloy article can replace a conventional method of direct chill casting an aluminum alloy ingot. The continuous casting can be performed by any suitable continuous caster such as a twin belt caster, twin block caster or twin roll caster. In some examples, the aluminum alloy article as cast has a thickness of from about 50 mm to about 5 mm. For example, a continuously cast aluminum alloy article can have a gauge thickness of at or about 50 mm, 45 mm, 40 mm, 35 mm, 30 mm, 25 mm, 20 mm, 15 mm, 10 mm, 5 mm, or anywhere in between, upon exiting the continuous caster. In some non-limiting examples, the aluminum alloy article is cast to a gauge between about 15 mm to about 25 mm. In some cases, the aluminum alloy article is cast to a gauge of from about 15 mm to about 40 mm. Obtaining an aluminum alloy article having a similar thickness as the continuously cast aluminum article from an aluminum alloy ingot can require additional processing steps, including ingot homogenization, scalping, and breakdown rolling. In some cases, casting a thinner gauge cast aluminum alloy article (e.g., up to about 50 mm) directly from a molten alloy can significantly reduce processing time and cost. In some non-limiting examples, upon exiting a continuous casting device, the aluminum alloy article can have a caster exit temperature of from at or about 350° C. to at or about 500° C. For example, the aluminum alloy article can have a caster exit temperature of at or about 350° C., 360° C., 370° C., 380° C., 390° C., 400° C., 410° C., 420° C., 430° C., 440° C., 450° C., 460° C., 470° C., 480° C., 490° C., 500° C., 510° C., 520° C., 530° C., 540° C., 550° C., 560° C., or anywhere in between.

The aluminum alloy article can be reheated at block 30. In some cases, reheating at block 30 can include solutionizing. Solutionizing can refer to a thermal treatment employed to evenly distribute alloying elements throughout an aluminum matrix within the aluminum alloy article (e.g., create a solid solution). In some examples, solutionizing a continuously cast aluminum alloy article can be performed more efficiently than solutionizing an aluminum alloy plate created from an aluminum alloy ingot. Solutionizing an aluminum alloy plate created from an aluminum alloy ingot is typically performed by heating the aluminum alloy plate created from the ingot to a solutionization temperature of about 560° C. and soaking the aluminum alloy plate at a temperature of about 560° C. for up to about 1 hour. In some examples, reheating a continuously cast aluminum alloy article as disclosed herein can be performed at a peak metal temperature of from at or about 420° C. to at or about 580° C. (e.g., at or about 420° C., 430° C., 440° C., 450° C., 460° C., 470° C., 480° C., 490° C., 500° C., 510° C., 520° C., 530° C., 540° C., 550° C., 560° C., 570° C., 580° C., or anywhere in between) having a soak time of less than about 5 minutes (e.g., less than about 5 minutes, less than about 4 minutes, less than about 3 minutes, less than about 2 minutes, less than about 1 minute, or anywhere in between). In some non-limiting examples, reheating a continuously cast aluminum alloy article is performed at about 560° C. for less than about 3 minutes. In some aspects, decreasing the reheating temperature can require increasing the soak time, and vice versa. The aluminum alloy article can have a furnace exit temperature of from at or about 420° C. to at or about 580° C. (e.g., at or about 420° C., 430° C., 440° C., 450° C., 460° C., 470° C., 480° C., 490° C., 500° C., 510° C., 520° C., 530° C., 540° C., 550° C., 560° C., 570° C., 580° C., or anywhere in between). In some cases, reheating is not performed. In some non-limiting examples, the furnace can be employed to maintain the caster exit temperature of the aluminum alloy article during passage from the continuous casting device to the rolling mill.

In box 40 (see FIG. 1), hot rolling to final gauge refers to reducing the gauge thickness of the aluminum alloy article to produce an aluminum alloy article having a desired thickness (e.g., gauge). In some cases, hot rolling to final gauge results in a thick gauge aluminum alloy article (e.g., having a thickness of about 4 mm or greater such as, but not limited to, between about 4 mm and about 15 mm or between about 6 mm and about 15 mm). In some cases, hot rolling a continuously cast aluminum alloy article to a final gauge can be performed more efficiently than a comparative method of breaking down an aluminum alloy ingot from a thickness of from about 450 mm to about 600 mm to a thickness of about 4 mm or greater. In some examples, hot rolling a continuously cast aluminum alloy article from a gauge of from about 15 mm to about 40 mm to a final gauge of about 4 mm or greater can be performed in a single pass through a hot rolling mill. In some cases, the aluminum alloy article is hot rolled to a gauge between about 4 mm and about 15 mm or between about 6 mm and about 15 mm. In some cases, the percentage reduction in thickness in a single pass through the hot rolling mill can be at or about at least 35%, 40%, 45%, 50%, 55%, 60%, 65%, or 70%. In some cases, hot rolling a continuously cast aluminum alloy article from a gauge between at or about 15 mm and 40 mm to a final gauge of about 4 mm or greater (such as, for example, between about 4 mm and about 15 mm or between about 6 mm and about 15 mm) can be performed at a temperature of from about 400° C. to about 480° C. (e.g., at or about 400° C., 410° C., 420° C., 430° C., 440° C., 450° C., 460° C., 470° C., 480° C., or anywhere in between) and the aluminum alloy article can have a hot rolling mill entry temperature of from at or about 350° C. to at or about 560° C. For example, an aluminum alloy article can have a hot rolling mill entry temperature of at or about 350° C., 360° C., 370° C., 380° C., 390° C., 400° C., 410° C., 420° C., 430° C., 440° C., 450° C., 460° C., 470° C., 480° C., 490° C., 500° C., 510° C., 520° C., 530° C., 540° C., 550° C., 560° C., or anywhere in between. In some non-limiting examples, the aluminum alloy article can exit the furnace (e.g., solutionizing furnace) having a temperature of at or about 560° C. and have a hot rolling mill entry temperature of at or about 530° C. In some non-limiting examples, hot rolling is performed at a temperature as hot as possible without melting the aluminum alloy article.

In some aspects, the aluminum alloy article can be subjected to hot rolling (e.g., reduction in thickness) from an as-continuously-cast gauge to a final gauge without any cold rolling. In some non-limiting examples, the aluminum alloy article can be reduced to a thick gauge aluminum article, such as about 4 mm or greater, such as a aluminum alloy plate, shate, slab, sheet plate, etc. In some non-limiting examples, during hot rolling the aluminum alloy gauge can be reduced by from about 0% to about 88%. For example, the aluminum alloy article can be subjected to a reduction in gauge of 0%, 2%, 4%, 6%, 8%, 10%, 12%, 14%, 16%, 18%, 20%, 22%, 24%, 26%, 28%, 30%, 32%, 34%, 36%, 38%, 40%, 42%, 44%, 46%, 48%, 50%, 52%, 54%, 56%, 58%, 60%, 62%, 64%, 66%, 68%, 70%, 72%, 74%, 76%, 78%, 80%, 82%, 84%, 86%, 88%, or anywhere in between. In some cases, the reduction in thickness at block 40 can be at least at or about 35%, 36%, 37%, 38%, 39%, 40%, 41%, 42%, 43%, 44%, 45%, 46%, 47%, 48%, 49%, or 50%. In some aspects, the aluminum alloy article can be hot rolled to a final gauge of about 4 mm or greater, such as between about 4 mm and 15 mm or between about 6 mm and about 15 mm. In some examples, the final gauge of the thick gauge aluminum alloy article is about 4 mm, about 5 mm, about 6 mm, about 7 mm, about 8 mm, about 9 mm, about 10 mm, about 11 mm, about 12 mm, about 13 mm, about 14 mm, or about 15 mm, or anywhere in between.

In some examples, the rolled aluminum alloy article can have a hot rolling mill exit temperature of from at about 380° C. to at about 450° C. For example, the aluminum alloy article can have a hot rolling mill exit temperature of at about 380° C., 390° C., 400° C., 410° C., 420° C., 430° C., 440° C., 450° C., or anywhere in between. In some non-limiting examples, the aluminum alloy article has a hot rolling mill exit temperature of at about 400° C.

In some non-limiting examples, the aluminum alloy article can be thermally quenched upon exiting the rolling mill. Quenching can be performed with water and/or forced air. In some non-limiting examples, quenching is performed by spraying water onto at least a first side of the aluminum alloy article. In some cases, quenching is performed by spraying water onto a first side of the aluminum alloy article and a second side of the aluminum alloy article. In some aspects, the aluminum alloy article can be quenched by immersion in water. In some non-limiting examples, quenching can be performed at a rate of at least at or about 100° C./second (° C./s). For example, quenching can be performed at a rate of at or about 100° C./s, 120° C./s, 140° C./s, 160° C./s, 180° C./s, 200° C./s, 220° C./s, 240° C./s, 260° C./s, or anywhere in between. In some examples, the aluminum alloy article can be quenched to or below a temperature between at or about 200° C. and 130° C. For example, the aluminum alloy article can be quenched to a temperature of at or about 200° C. or below, at or about 190° C. or below, at or about 180° C. or below, at or about 170° C. or below, at or about 160° C. or below, at or about 150° C. or below, at or about 140° C. or below, at or about 130° C. or below, or anywhere in between.

Optionally, quenching can be performed before rolling (e.g., to perform a lower temperature rolling, sometimes referred to as warm rolling). In some cases, quenching can be performed before rolling and after rolling. In some further cases, quenching is not performed or only minimal quenching is performed (e.g., the aluminum alloy article can be minimally quenched to a temperature of at or about 395° C. or below, at or about 390° C. or below, at or about 385° C. or below, at or about 380° C. or below, at or about 375° C. or below, at or about 370° C. or below, at or about 365° C. or below, at or about 360° C. or below, or anywhere in between, upon exiting the hot rolling mill). In some examples, quenching can be performed at any point in the methods described herein as desired.

Warm rolling to final gauge can refer to reducing the gauge thickness of the aluminum alloy article at a temperature less than hot rolling to produce a thick gauge aluminum alloy article having a desired gauge (e.g., about 4 mm or greater, such as between about 4 mm and about 15 mm or between about 6 mm and about 15 mm), wherein the reduction occurs at a temperature between cold rolling and hot rolling (e.g., below a recrystallization temperature). In some cases, warm rolling a continuously cast aluminum alloy article to a final gauge can be performed to produce a thick gauge aluminum alloy article having a temper similar to any suitable temper achieved by performing cold rolling. In some examples, warm rolling a continuously cast aluminum alloy article from a gauge between at or about 15 mm and 40 mm to a final gauge of about 4 mm or greater (such as, but not limited to, between about 4 mm and about 15 mm or between about 6 mm and about 15 mm) can be performed in a single pass through a warm rolling mill (e.g., a hot rolling mill operating at lower temperatures). In some cases, warm rolling a continuously cast aluminum alloy article from a gauge of from at or about 15 mm to at or about 40 mm to a final gauge of from about 4 mm or greater (such as, but not limited to, between about 4 mm and about 15 mm or between about 6 mm and about 15 mm) can be performed at a temperature of from at or about 300° C. to at or about 400° C. (e.g., at or about 300° C., 310° C., 320° C., 330° C., 340° C., 350° C., 360° C., 370° C., 380° C., 390° C., 400° C., or anywhere in between) and the aluminum alloy article can have a rolling mill entry temperature for warm rolling of from at or about 350° C. to at or about 480° C. For example, a thick gauge aluminum alloy article can have a rolling mill entry temperature of at or about 350° C., 360° C., 370° C., 380° C., 390° C., 400° C., 410° C., 420° C., 430° C., 440° C., 450° C., 460° C., 470° C., 480° C., or anywhere in between. In some non-limiting examples, the thick gauge aluminum alloy article can exit the furnace (e.g., solutionizing furnace) at a temperature of at or about 560° C. and be subjected to quenching to a temperature of from at or about 300° C. to at or about 480° C. (e.g., at or about 300° C., 310° C., 320° C., 330° C., 340° C., 350° C., 360° C., 370° C., 380° C., 390° C., 400° C., 410° C., 420° C., 430° C., 440° C., 450° C., 460° C., 470° C., 480° C., or anywhere in between). The thick gauge aluminum alloy article can have a rolling mill entry temperature for warm rolling of less than at or about 480° C. In some non-limiting examples, warm rolling is performed at a temperature of less than at or about 350° C.

In some aspects, the aluminum alloy article can be subjected to warm rolling (e.g., reduction in thickness) from an as-continuously-cast gauge to a final gauge. In some non-limiting examples, the aluminum alloy article can be reduced to a thick gauge aluminum alloy article, for example an aluminum alloy article having a thickness of about 4 mm or greater (such as, but not limited to, between about 4 mm and about 15 mm or between about 6 mm and about 15 mm). In some non-limiting examples, during warm rolling the aluminum alloy gauge can be reduced by from about 0% to about 88%. For example, the aluminum alloy article can be subjected to a reduction in gauge of 0%, 2%, 4%, 6%, 8%, 10%, 12%, 14%, 16%, 18%, 20%, 22%, 24%, 26%, 28%, 30%, 32%, 34%, 36%, 38%, 40%, 42%, 44%, 46%, 48%, 50%, 52%, 54%, 56%, 58%, 60%, 62%, 64%, 66%, 68%, 70%, 72%, 74%, 76%, 78%, 80%, 82%, 84%, 86%, 88%, or anywhere in between. In some cases, the reduction in thickness at block 40 can be at least at or about 35%, 36%, 37%, 38%, 39%, 40%, 41%, 42%, 43%, 44%, 45%, 46%, 47%, 48%, 49%, or 50%. In some aspects, the aluminum alloy article can be warm rolled to a final gauge of about 4 mm or greater. In some examples, the article is warm rolled to a final gauge between about 4 mm and about 15 mm or between about 6 mm and about 15 mm.

Optionally, the aluminum alloy article can be reheated (e.g., solutionized) after hot or warm rolling. In some examples, reheating a hot or warm rolled continuously cast aluminum alloy article as disclosed herein can be performed at a peak metal temperature of from at or about 420° C. to at or about 580° C. (e.g., at or about 420° C., 430° C., 440° C., 450° C., 460° C., 470° C., 480° C., 490° C., 500° C., 510° C., 520° C., 530° C., 540° C., 550° C., 560° C., 570° C., 580° C., or anywhere in between) having a soak time of less than about 5 minutes (e.g., less than about 5 minutes, less than about 4 minutes, less than about 3 minutes, less than about 2 minutes, less than about 1 minute, or anywhere in between). In some non-limiting examples, reheating a continuously cast aluminum alloy article is performed at about 560° C. for less than about 3 minutes. In some aspects, decreasing the reheating temperature can require increasing the soak time, and vice versa. The aluminum alloy article can have a furnace exit temperature of from at or about 420° C. to at or about 580° C. (e.g., at or about 420° C., 430° C., 440° C., 450° C., 460° C., 470° C., 480° C., 490° C., 500° C., 510° C., 520° C., 530° C., 540° C., 550° C., 560° C., 570° C., 580° C., or anywhere in between). In some cases, reheating is not performed after hot or warm rolling.

In box 50 (see FIG. 1), cutting to length refers to cutting the rolled thick gauge aluminum alloy articles to a desired length (e.g., as requested by a customer) in-situ after quenching. In some non-limiting examples, aluminum alloy material is not coiled for post-production applications including storage, aging and shipping, to name a few. In some cases, after cutting, the thick gauge aluminum alloy articles (in some examples, aluminum alloy plates, shates, slabs, sheet plates or the like) can be stacked for post-production applications including storage, aging, and/or shipping, to name a few. The thick gauge aluminum alloy articles can have a stacking temperature of from at or about 100° C. or below to at or about 250° C. or below. For example, the thick gauge aluminum alloy articles can be stacked at or below a temperature of at or about 100° C., 110° C., 120° C., 130° C., 140° C., 150° C., 160° C., 170° C., 180° C., 190° C., 200° C., 210° C., 220° C., 230° C., 240° C., 250° C., or anywhere in between.

In some non-limiting examples, the stacking temperature can affect a temper of the thick gauge aluminum alloy articles. For example, stacking solutionized thick gauge aluminum alloy articles at a stacking temperature of at or about 100° C. can result in thick gauge aluminum alloy articles having a T4 temper. In some cases, stacking solutionized AA6xxx series thick gauge aluminum alloy articles at a stacking temperature of at or about 200° C. can result in AA6xxx thick gauge aluminum alloy articles having a T6 temper. In some other cases, stacking the same AA6xxx thick gauge aluminum alloy articles at a stacking temperature of at or about 250° C. can result in AA6xxx thick gauge aluminum alloy articles having a T7 temper. In some further cases, stacking solutionized AA7xxx series thick gauge aluminum alloy articles at a stacking temperature of at or about 165° C. and maintaining that temperature for at or about 24 hours can provide AA7xxx series thick gauge aluminum alloy articles having a T7 temper. Other stacking temperatures and times can be used to affect the temper of the thick gauge aluminum alloy articles as appropriate.

In box 60 (see FIG. 1), artificial aging can refer to a thermal treatment process that can impart desired tempers to provided thick gauge aluminum alloy articles (in some examples, aluminum alloy plates, shates, slabs, sheet plates or the like). In some non-limiting examples, artificial aging is accomplished as part of the stacking process, such as described above. In some further examples, artificial aging is performed by further subjecting the thick gauge aluminum alloy articles to an elevated temperature suitable for artificial aging.

Figure 2:
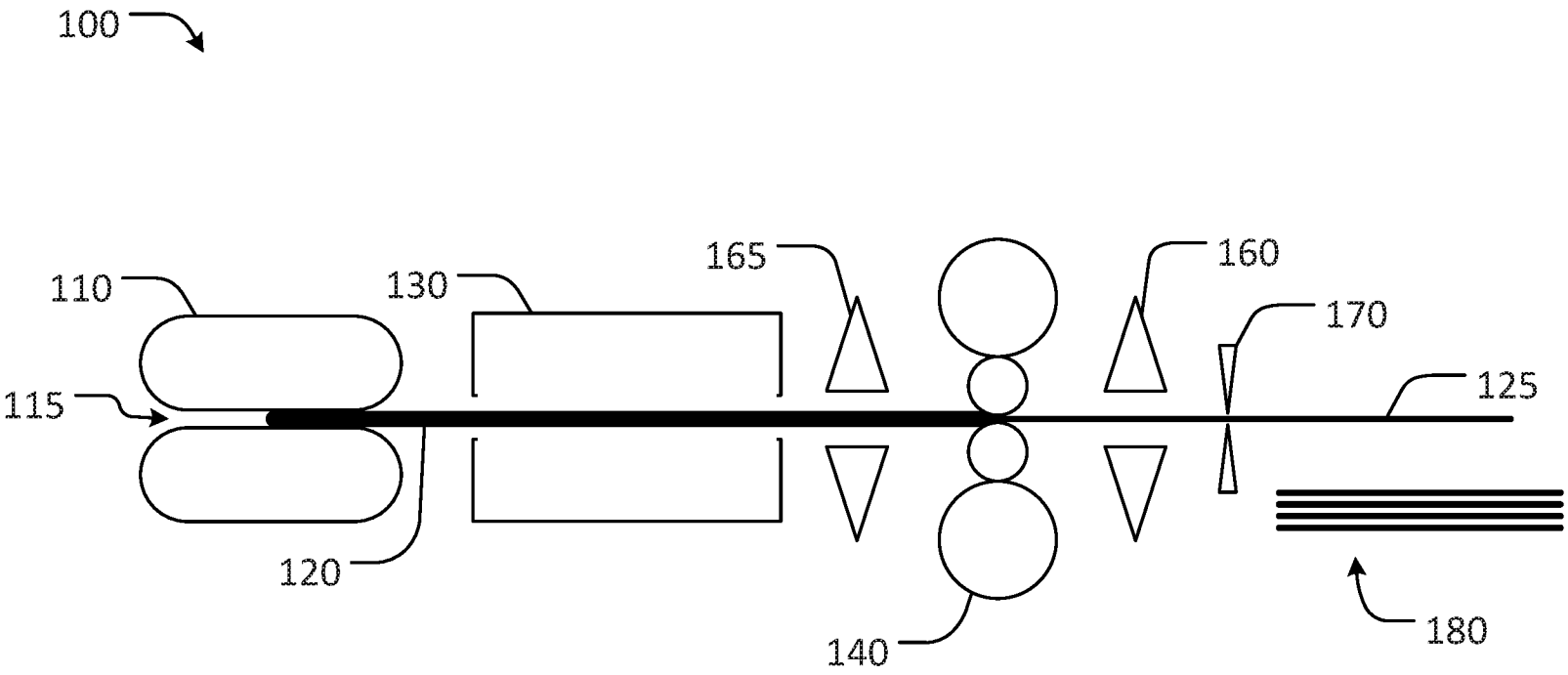
FIG. 2 is a schematic diagram depicting a processing line according to certain aspects of the present disclosure.

FIG. 2 is a schematic diagram depicting a continuous casting system 100 according to certain aspects and features of the present disclosure. In some non-limiting examples, a pair of moving opposed casting surfaces 110 define a casting cavity 115 between the pair of moving opposed casting surfaces 110. The pair of moving opposed casting surfaces 110 can be a twin roll caster or a twin belt caster, or any other suitable continuous casting device. A molten metal injector positioned upstream of the pair of moving opposed casting surfaces 110 can inject molten metal (e.g., a molten aluminum alloy) into the casting cavity 115 between the pair of moving opposed casting surfaces 110. The pair of moving opposed casting surfaces 110 can cast the molten aluminum alloy into a metal article, for example, an aluminum alloy article 120. Casting the molten aluminum alloy into an aluminum alloy article 120 can include rapidly extracting heat from the molten aluminum alloy as the molten aluminum alloy article moves through the casting cavity 115 and the aluminum alloy article 120 exits the casting cavity 115. A furnace 130 positioned downstream of the pair of moving opposed casting surfaces 110 can be employed to reheat the aluminum alloy article 120. In some cases, the furnace 130 can be a solutionizing furnace, which can be employed to solutionize the aluminum alloy article 120. Optionally, the furnace 130 can be employed to maintain the cast exit temperature of the aluminum alloy article 120. In some cases, the furnace 130 can operate at a temperature above the cast exit temperature of the aluminum alloy article 120, in which case optional heating elements positioned upstream of the furnace 130 can increase the temperature of the aluminum alloy article 120 before it enters the furnace 130. A rolling mill 140 positioned downstream of the furnace 130 can be used to reduce the thickness of the aluminum alloy article 120, resulting in a thick gauge aluminum alloy article 125 (e.g., the rolling mill 140 can roll the aluminum alloy article 120 into a thick gauge aluminum alloy article 125). A quenching device 160 positioned downstream of the rolling mill 140 can be used to quench (e.g., rapidly cool) the thick gauge aluminum alloy article 125. A plate shearing device 170 positioned downstream of the quenching device 160 can be employed to cut the thick gauge aluminum alloy article 125 to a desired length. If desired, the cut thick gauge aluminum alloy article 125 can then be stacked into a stack 180 of thick gauge aluminum alloy articles 125 for any suitable further downstream processing.

Optionally, a second quenching device 165 can be positioned upstream of the rolling mill 140 to quench the aluminum alloy article 120 prior to rolling. In some cases, such a second quenching device 165 can be suitable for use with a warm rolling procedure (e.g., rolling at temperatures below the recrystallization temperature). In some cases, the use of a second quenching device 165 immediately before rolling can result in the thick gauge aluminum alloy article 125 having mechanical properties similar to aluminum alloy rolled articles having a T3 or a T8 temper (e.g., high strength, and precipitation hardened). For example, the methods described above can provide thick gauge aluminum alloy articles (e.g., plates, shates, slabs, sheet plates, etc.) having mechanical properties similar to aluminum alloy articles produced via cold working (e.g., cold rolling) even though the thick gauge aluminum alloy articles described herein are not cold rolled. In some aspects, mechanical properties exhibited by aluminum alloys having a T3 or a T8 temper as described above can be imparted to the thick gauge aluminum alloy articles described herein using the methods described herein. For example, where T8 temper properties are desired, an aluminum alloy can be subjected to continuous casting, solutionizing, quenching, hot rolling to a final gauge and quenching after hot rolling, described in detail below.

In some non-limiting examples, the continuous casting system 100 can be arranged in a plurality of configurations to provide a specifically-tailored thermal history for the thick gauge aluminum alloy articles 125. For example, an AA6xxx series aluminum alloy in T4, T6, or T7 temper can be produced by casting an aluminum alloy article 120 such that the aluminum alloy article 120 exiting the casting cavity 115 has a caster exit temperature of about 450° C., solutionizing in the solutionizing furnace 130 at a temperature of about 560° C., and subjecting the aluminum alloy article 120 to a 50% reduction in the rolling mill 140 at a temperature between approximately 530° C. and 580° C. For T4 temper, the thick gauge aluminum alloy article 125 can exit the rolling mill 140 and be immediately quenched using a quenching device 160 to a temperature at or below 200° C., then cut using cutting device 160 and stacked at a temperature at or below 100° C. For T6 temper, the thick gauge aluminum alloy article 125 can exit the rolling mill 140 and be immediately quenched using a quenching device 160 to a temperature at or about 200° C., then cut using cutting device 160 and stacked at a temperature at or about 200° C. For T7 temper, the thick gauge aluminum alloy article 125 can exit the rolling mill 140 and be immediately quenched using a quenching device 160 to a temperature at or about 250° C., then cut using cutting device 160 and stacked at a temperature at or about 250° C.

In another example, an AA6xxx series aluminum alloy having T3 or T8 temper properties (e.g., high strength) can be produced without cold rolling. The AA6xxx series aluminum alloy having T3 or T8 temper properties can be provided by casting an aluminum alloy article 120 such that the aluminum alloy article 120 exiting the casting cavity 115 has a caster exit temperature of about 450° C., solutionizing in the solutionizing furnace 130 at a temperature of about 560° C., then quenching the aluminum alloy article 120 using quenching device 165 to a temperature of about 470° C. before subjecting the aluminum alloy article 120 to a 50% reduction in the rolling mill 140 at a temperature below approximately 500° C., such as at or about 470° C. The resultant thick gauge aluminum alloy article 125 can exit the rolling mill 140 at a rolling mill exit temperature of about 400° C. and be immediately quenched using quenching device 160 to a temperature of at or below about 200° C. To provide the AA6xxx series aluminum alloy having T3 temper properties, the thick gauge aluminum alloy article 125 can be cut using cutting device 160 and stacked at a temperature at or below 100° C. To provide the AA6xxx series aluminum alloy having T8 temper properties, the thick gauge aluminum alloy article 125 can be cut using cutting device 160 and stacked at a temperature at or about 200° C. To provide the AA6xxx series aluminum alloy having T8x temper properties, the thick gauge aluminum alloy article 125 can be cut using cutting device 160, stacked at a temperature at or about 200° C., and artificially aged.

The following examples will serve to further illustrate the present invention without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention. During the studies described in the following examples, conventional procedures were followed, unless otherwise stated. Some of the procedures are described below for illustrative purposes.

EXAMPLE

Various alloys were prepared for strength, elongation, and formability testing. The chemical compositions for these alloys are provided in Table 1 below.

TABLE 1

| Alloy Compositions | | |
|---|---|---|
| Element | Alloy A | Alloy B |
| Si | 0.70 | 0.80 |
| Fe | 0.20 | 0.20 |
| Cu | 0.85 | 0.80 |
| Mn | 0.30 | 0.18 |
| Mg | 0.90 | 0.80 |
| Ti | 0.04 | 0.02 |
| Cr | 0.03 | 0.07 |
| Zr | 0.12 | 0.00 |
| Impurities | 0.05(each)<br>0.15(total) | 0.05(each)<br>0.15(total) |
| Al | Remainder | Remainder |

All values expressed as weight percentage (wt. %) of the whole.

Alloy A and Alloy B (see Table 1) were provided in a T4 temper, a partial T6 temper, and a full T6 temper by employing the methods described above and optional artificial aging. For example, Alloy A and Alloy B can be produced by the methods depicted in FIG. 1, including casting an aluminum alloy article such that the aluminum alloy article exiting the casting cavity 115 has a caster exit temperature of about 450° C., solutionizing in the solutionizing furnace 130 at a temperature of from about 550° C. to about 570° C. for 2 minutes, and subjecting the aluminum alloy article 120 to about a 40% to about a 70% reduction in the rolling mill 140 at a temperature between approximately 530° C. and 580° C. Alloy A was reduced about 40% to a gauge of 9.5 mm. Alloy B was reduced about 70% to a gauge of 5.0 mm. For T4 temper, a thick gauge aluminum alloy article can exit the rolling mill 140 and be immediately quenched using the quenching device 160 to a temperature at or below 50° C., then cut using the cutting device 160 and stacked at a temperature at or below 100° C. For partial T6 temper, the thick gauge aluminum alloy articles can be artificially aged at 200° C. for 2 hours. For full T6 temper, the thick gauge aluminum alloy articles can be artificially aged at 180° C. for 10 hours.

Figure 3:
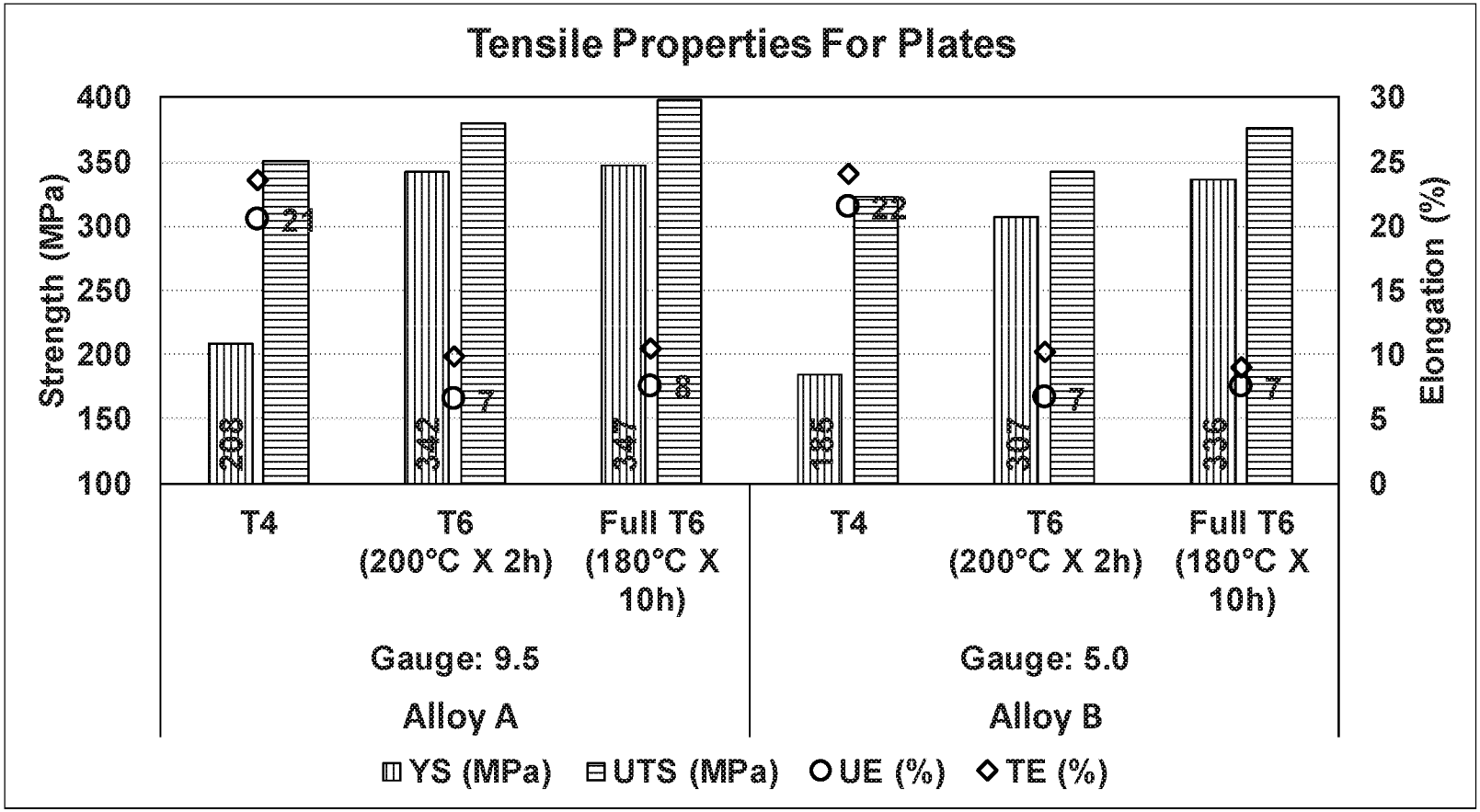
FIG. 3 is a chart depicting mechanical properties of aluminum alloy articles according to certain aspects of the present disclosure.

FIG. 3 is a chart depicting mechanical properties of thick gauge aluminum alloy articles made from Alloy A and Alloy B. Both Alloy A and Alloy B exhibited high strength after artificial aging (e.g., in partial T6 temper and full T6 temper) having yield strength (referred to as "YS" in FIG. 3) (left histogram in each group) of from about 330 MPa to about 345 MPa. Both Alloy A and Alloy B exhibited ample strength after natural aging (e.g., in T4 temper) having yield strength (left histogram in each group) of from about 180 MPa to about 200 MPa, and excellent deformability (e.g., uniform elongation, referred to as "UE" in FIG. 3 and represented by open circles) of about 21% to about 22% UE. In some aspects, having a UE of about 21% to about 22% can allow a 90° bend during forming (e.g., stamping, or bending) without fracture or failure. Additionally, Alloy A and Alloy B exhibited high ultimate tensile strengths (referred to as "UTS" in FIG. 3) (right histogram in each group), as well as high total elongation before fracture (referred to as "TE" in FIG. 3 and represented by open diamonds).

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a method for producing rolled aluminum alloy articles, including providing a molten aluminum alloy, continuously casting an aluminum alloy article from the molten aluminum alloy, and rolling the aluminum alloy article at a rolling temperature of at least from about 300° C. to about 580° C. to a gauge of about 4 millimeters (mm) or greater to produce a rolled aluminum alloy article.

Example 2 is the method of example 1, further including reheating the aluminum alloy article after continuous casting and before hot or warm rolling.

Example 3 is the method of examples 1-2, wherein reheating the aluminum alloy article includes reheating the aluminum alloy article to a peak metal temperature from about 420° C. to about 580° C. and maintaining the peak metal temperature for a duration of between about 1 minute to about 5 minutes.

Example 4 is the method of examples 1-3, wherein the molten aluminum alloy includes an AA7xxx series aluminum alloy, and wherein reheating the aluminum alloy article comprises reheating the aluminum alloy article to a peak metal temperature of at or approximately 480° C.

Example 5 is the method of examples 1-4, wherein the molten aluminum alloy includes an AA6xxx series aluminum alloy, and wherein reheating the aluminum alloy article comprises reheating the aluminum alloy article to a peak metal temperature of at or approximately 560° C.

Example 6 is the method of examples 1-5, further including quenching the rolled aluminum alloy article at a rate of at least about 100° C./second after rolling.

Example 7 is the method of examples 1-6, further including cutting the rolled aluminum alloy article after rolling to produce cut and rolled aluminum alloy articles.

Example 8 is the method of examples 1-7, further including stacking the cut and rolled aluminum alloy articles after cutting.

Example 9 is the method of examples 1-8, wherein stacking the cut and rolled aluminum alloy articles after cutting is performed at a cut and rolled aluminum alloy article temperature of from about 100° C. to about 250° C.

Example 10 is the method of examples 1-9, wherein stacking the cut and rolled aluminum alloy articles after cutting is performed at the cut and rolled aluminum alloy article temperature of from about 100° C. to about 250° C. can provide a cut and rolled aluminum alloy article in a desired temper.

Example 11 is the method of examples 1-10, further including artificially aging the rolled aluminum alloy article.

Example 12 is the method of examples 1-11, wherein a continuous casting exit temperature of the aluminum alloy article is from about 350° C. to about 500° C.

Example 13 is the method of examples 1-12, wherein rolling the aluminum alloy article includes warm rolling the aluminum alloy article at a warm rolling temperature of from about 300° C. to about 400° C. to a gauge of about 4 mm or greater to produce the rolled aluminum alloy article.

Example 14 is a continuous casting system, including a pair of moving opposed casting surfaces spaced apart to define a casting cavity therebetween, wherein the casting cavity is sized to cast a metal article at a first thickness, a solutionizing furnace positioned downstream of the pair of moving opposed casting surfaces, a rolling mill positioned downstream of the solutionizing furnace, wherein the rolling mill is configured to reduce a cast metal article from the first thickness to a thickness of at least 4 mm, a quenching device positioned downstream of the rolling mill, a cutting device positioned downstream of the quenching device, and a stacking device positioned downstream of the cutting device.

Example 15 is the system of example 14, further including a quenching device positioned upstream of the rolling mill.

Example 16 is the system of examples 14-15, wherein the continuous casting system is thermally configurable to produce an aluminum alloy article having a desired temper.

Example 17 is a rolled aluminum alloy article, which is formed by a process including providing a molten aluminum alloy, continuously casting an aluminum alloy article from the molten aluminum alloy, and rolling the aluminum alloy article at a rolling temperature of at least about 400° C. to a gauge of about 4 mm or greater to produce the rolled aluminum alloy article.

Example 18 is the rolled aluminum alloy article of example 17, further including cutting the rolled aluminum alloy article in situ to provide a thick gauge cut aluminum alloy article, and stacking the thick gauge cut aluminum alloy article at a temperature of from about 100° C. to about 250° C.

Example 19 is the thick gauge cut aluminum alloy article of examples 17-18, wherein the thick gauge cut aluminum alloy article can be provided in a T4 temper, a T6 temper, or a T7 temper after stacking the thick gauge aluminum alloy article at the temperature of from about 100° C. to about 250° C.

Example 20 is the rolled aluminum alloy article of examples 17-18, wherein the thick gauge cut aluminum alloy article comprises mechanical properties of a cold worked aluminum alloy article having T3 or T8 temper properties after stacking the thick gauge aluminum alloy article at the temperature of from about 100° C. to about 250° C.

Example 21 is the rolled aluminum alloy article of examples 17-20, wherein the continuously cast aluminum alloy article has a gauge of about 50 mm or less.

What is claimed is:

1. A method for producing rolled aluminum alloy articles, comprising:

providing a molten aluminum alloy;

continuously casting an aluminum alloy article from the molten aluminum alloy;

reheating the aluminum alloy article after continuously casting, wherein the reheating the aluminum alloy article comprises reheating the aluminum alloy article to a peak metal temperature from 420° C. to 580° C. and maintaining the peak metal temperature for a duration consisting of 1 minute to 5 minutes;

quenching the aluminum alloy article after continuously casting with a quenching device; and after quenching and reheating, rolling the aluminum alloy article at a rolling temperature from 300° C. to 580° C. to a gauge of 4 millimeters (mm) or greater to produce a rolled aluminum alloy article.

2. The method of claim 1, wherein the molten aluminum alloy comprises an AA7xxx series aluminum alloy, and wherein reheating the aluminum alloy article comprises reheating the aluminum alloy article to a peak metal temperature of at least 480° C.

3. The method of claim 1, wherein the molten aluminum alloy comprises an AA6xxx series aluminum alloy, and wherein reheating the aluminum alloy article comprises reheating the aluminum alloy article to a peak metal temperature of at least 560° C.

4. The method of claim 1, further comprising quenching the rolled aluminum alloy article at a rate of at least 100° C./second after rolling.

5. The method of claim 1, further comprising cutting the rolled aluminum alloy article after rolling to produce cut and rolled aluminum alloy articles.

6. The method of claim 5, further comprising stacking the cut and rolled aluminum alloy articles after cutting.

7. The method of claim 6, wherein stacking the cut and rolled aluminum alloy articles after cutting is performed at a cut and rolled aluminum alloy article temperature of from 100° C. to 250° C.

8. The method of claim 7, wherein stacking the cut and rolled aluminum alloy articles controls a temper.

9. The method of claim 7, wherein stacking the cut and rolled aluminum alloy articles controls a temper without cold rolling.

10. The method of claim 1, further comprising artificially aging the rolled aluminum alloy article.

11. The method of claim 1, wherein a continuous casting exit temperature of the aluminum alloy article is from 350° C. to 500° C.

12. The method of claim 1, wherein rolling the aluminum alloy article comprises warm rolling the aluminum alloy article at a warm rolling temperature of from 300° C. to 400° C.

* * * * *